US010414628B2

(12) United States Patent
Terry et al.

(10) Patent No.: US 10,414,628 B2
(45) Date of Patent: Sep. 17, 2019

(54) ELEVATOR SYSTEM DEVICE WITH AUTHORIZED ACCESS CONTROL

(71) Applicant: OTIS ELEVATOR COMPANY, Farmington, CT (US)

(72) Inventors: Harold Terry, New Hartford, CT (US); Peter DePaola, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 322 days.

(21) Appl. No.: 15/593,775

(22) Filed: May 12, 2017

(65) Prior Publication Data

US 2018/0327216 A1 Nov. 15, 2018

(51) Int. Cl.

| | |
|---|---|
| ***B66B 1/46*** | (2006.01) |
| ***B66B 1/52*** | (2006.01) |
| ***B66B 5/00*** | (2006.01) |
| *B66B 9/00* | (2006.01) |

(52) U.S. Cl.

CPC ..... *B66B 1/468* (2013.01); *B66B 1/46* (2013.01); *B66B 1/52* (2013.01); *B66B 5/0087* (2013.01); *B66B 9/00* (2013.01); *B66B 2201/463* (2013.01); *B66B 2201/4615* (2013.01); *B66B 2201/4638* (2013.01)

(58) Field of Classification Search

CPC ..... B66B 1/46; B66B 1/52; B66B 5/0087
USPC ..... 187/389
See application file for complete search history.

(56) References Cited

U.S. PATENT DOCUMENTS 3,813,624 A 5/1974 Deitch
4,848,812 A * 7/1989 Slaughter ..... E05C 19/163 292/144

(Continued)

FOREIGN PATENT DOCUMENTS

CN 104576190 4/2015
CN CN1045761901 4/2015

(Continued)

OTHER PUBLICATIONS

Extended European Search Report for Application No. EP 18 17 1941 dated Nov. 21, 2018.

(Continued)

*Primary Examiner* — David S Warren
(74) *Attorney, Agent, or Firm* — Carlson, Gaskey & Olds

(57) ABSTRACT

An illustrative example elevator system device includes an interface configured to operate in a first mode that allows an elevator passenger to communicate with the elevator system. The elevator passenger may communicate with the elevator system by inputting an indication for desired elevator service or receive an indication regarding elevator service. A magnetically actuated switch selectively causes the interface to operate in a second mode that allows an authorized individual to communicate with the elevator system in a manner that is different than an elevator passenger communication in the first mode. The magnetically activated switch includes at least one magnet and at least one switch contact that changes between an open and closed state based on an interaction between the at least one magnet and a magnetic key brought into proximity of the at least one magnet by the authorized individual.

20 Claims, 3 Drawing Sheets

(56) References Cited

U.S. PATENT DOCUMENTS

| | | | | |
|---|---|---|---|---|
| 5,076,623 | A * | 12/1991 | Richards | E05B 47/0038 292/144 |
| 5,283,546 | A | 2/1994 | Scop et al. | |
| 5,485,733 | A * | 1/1996 | Hoffman | E05B 47/004 70/276 |
| 5,668,533 | A | 9/1997 | Jackson, Jr. et al. | |
| 6,227,335 | B1 * | 5/2001 | Koeppe, Jr. | B66B 1/462 187/395 |
| 7,237,655 | B2 * | 7/2007 | Kocher | B66B 5/005 187/314 |
| 8,490,755 | B2 | 7/2013 | Lindberg | |
| 8,602,171 | B2 | 12/2013 | Vogl | |
| 8,746,415 | B2 | 6/2014 | Aluisetti | |
| 9,272,878 | B2 * | 3/2016 | Kocher | B66B 5/005 |
| 9,340,342 | B2 | 5/2016 | Brandon, II | |
| 9,745,169 | B2 * | 8/2017 | Sonnenmoser | B66B 1/468 |
| 2004/0173415 | A1 | 9/2004 | Kocher | |
| 2006/0117820 | A1 * | 6/2006 | Lanigan | B62D 33/0222 70/279.1 |
| 2009/0133969 | A1 * | 5/2009 | Zaharia | B66B 1/462 187/388 |
| 2009/0236183 | A1 * | 9/2009 | Bordwell | B66F 3/46 187/234 |
| 2012/0031708 | A1 * | 2/2012 | Aluisetti | B66B 1/468 187/380 |
| 2014/0353090 | A1 * | 12/2014 | MULLER | B66B 1/3492 187/393 |
| 2017/0174471 | A1 * | 6/2017 | Salmikuukka | B66B 11/0226 |
| 2017/0320705 | A1 * | 11/2017 | Honda | B66B 1/28 |
| 2018/0327216 | A1 * | 11/2018 | Terry | B66B 1/468 |
| 2018/0332368 | A1 * | 11/2018 | Copeland | H04L 67/12 |
| 2018/0334359 | A1 * | 11/2018 | Nikander | B66B 1/308 |
| 2018/0354748 | A1 * | 12/2018 | Lustenberger | B66B 5/0087 |
| 2018/0370758 | A1 * | 12/2018 | Huang | B66B 1/2408 |
| 2019/0031467 | A1 * | 1/2019 | Simcik | B66B 1/3461 |
| 2019/0077632 | A1 * | 3/2019 | Kondo | B66B 5/0025 |

FOREIGN PATENT DOCUMENTS

| | | |
|---|---|---|
| EP | 0320583 | 6/1989 |
| EP | 2955144 | 12/2015 |
| JP | H0326676 A | 2/1991 |

OTHER PUBLICATIONS

Goodwin, Rhys: Invisible Magnetic Reed Switches, Oct. 29, 2013, 12 pages, https://blog.rhysgoodwin.com/home-diy/invisible-magnetic-reed-switches.

Woodford, Chris: How reed switches work (magnetically operated switches), 11 pages; https://www.explainthatstuff.com/howreedswitcheswork.html.

* cited by examiner

ELEVATOR SYSTEM DEVICE WITH AUTHORIZED ACCESS CONTROL

BACKGROUND

Elevator systems include a variety of devices that allow individuals to interact with the elevator system. For example, traditional hall call buttons allow elevator passengers to provide an indication that elevator service is desired from a particular landing. Car operating panels traditionally have allowed passengers to enter a desired destination floor to which they desire to be carried. More recently, destination entry devices allow passengers to indicate a desired destination from outside of an elevator car. Destination entry devices also may provide information to the passenger regarding the requested elevator service, such as the car that will carry the passenger to the desired destination.

Some elevator devices also provide features that allow authorized individuals to access certain portions of the elevator system. For example, some elevator system devices include a keyhole to receive a key from an authorized individual. If an appropriate key is inserted and turned, for example, the device may operate in a manner that allows an authorized individual to perform certain tasks, such as controlling aspects of the elevator system or altering some functionality or feature of the system.

One drawback to some known devices is that they are susceptible to vandalism. Manual keyholes, for example, may be tempting to unauthorized individuals to attempt to gain access to an otherwise protected or unaccessible portion of the system. Configuring elevator system devices to be less susceptible to vandalism brings with it the challenge of making the device relatively accessible to an authorized individual.

SUMMARY

An illustrative example elevator system device includes an interface configured to operate in a first mode that allows an elevator passenger to communicate with the elevator system. The elevator passenger may communicate with the elevator system by inputting an indication for desired elevator service or receive an indication regarding elevator service. A magnetically actuated switch selectively causes the interface to operate in a second mode that allows an authorized individual to communicate with the elevator system in a manner that is different than an elevator passenger communication in the first mode. The magnetically activated switch includes at least one magnet and at least one switch contact that changes between an open and closed state based on an interaction between the at least one magnet and a magnetic key brought into proximity of the at least one magnet by the authorized individual.

In a further non-limiting embodiment of the elevator system of the previous paragraph, a surface is visible to the passenger or authorized individual. The magnetically actuated switch is situated behind a portion of the surface that conceals the magnetically actuated switch from the passenger.

In a further non-limiting embodiment of the elevator system of any of the previous paragraphs, the surface has a visible characteristic on the portion of the surface that does not provide any indication of the magnetically actuated switch behind the surface.

In a further non-limiting embodiment of the elevator system of any of the previous paragraphs, the magnetically actuated switch includes a biasing member that biases the at least one switch contact into a selected one of the open or closed states. The at least one magnet causes movement of the at least one switch contact into the other of the closed or open state by moving the at least one switch contact against the bias of the biasing member based on the interaction between the at least one magnet and the magnetic key.

In a further non-limiting embodiment of the elevator system of any of the previous paragraphs, the biasing member comprises a spring.

In a further non-limiting embodiment of the elevator system of any of the previous paragraphs, the biasing member comprises a hinge-style spring.

In a further non-limiting embodiment of the elevator system of any of the previous paragraphs, the device comprises a controller that controls whether the interface operates in the first mode or the second mode. Actuation of the magnetically actuated switch provides an indication to the controller to operate in the second mode to allow the authorized individual to communicate with the elevator system.

In a further non-limiting embodiment of the elevator system of any of the previous paragraphs, the at least one magnet has a selected magnetic pattern and the magnetic key has a corresponding magnetic pattern to activate the magnetically activated switch.

In a further non-limiting embodiment of the elevator system of any of the previous paragraphs, the at least one magnet is supported to move based on the interaction with the magnetic key and movement of the at least one magnet causes movement of the at least one switch contact between the open and closed states.

In a further non-limiting embodiment of the elevator system of any of the previous paragraphs, at least one of magnetic attraction or magnetic repulsion between the at least one magnet and the magnetic key causes the movement of the at least one magnet.

In a further non-limiting embodiment of the elevator system of any of the previous paragraphs, the at least one switch contact is electrically conductive when the at least one switch contact is in the closed state, the at least one switch contact is electrically conductive independent of a magnetic field of the at least one magnet and the at least one switch contact is electrically conductive independent of a magnetic field of the magnetic key.

In a further non-limiting embodiment of the elevator system of any of the previous paragraphs, a surface is adjacent to the interface, the surface is visible to the passenger, the magnetically actuated switch is concealed from the passenger's view behind the surface and the device includes an indication of the magnetically actuated switch position behind the surface.

In a further non-limiting embodiment of the elevator system of any of the previous paragraphs, the surface has an indicator or a characteristic that indicates that the magnetically actuated switch is behind the surface.

An illustrative example method of preventing unauthorized access to features of an elevator system device includes situating a passenger interface portion of the device in a location where the passenger interface portion is accessible by an elevator passenger. A magnetically actuated switch is situated near the passenger interface portion. The magnetically actuated switch controls an ability to access features of the elevator system. The magnetically actuated switch is concealed such that the switch is not visible to the elevator passenger.

In a further non-limiting embodiment of the method of the previous paragraph, the magnetically actuated switch is concealed behind a surface adjacent the passenger interface portion.

In a further non-limiting embodiment of the method of any of the previous paragraphs, the surface does not have any indicator or characteristic that would indicate that the magnetically actuated switch is behind the surface.

In a further non-limiting embodiment of the method of any of the previous paragraphs, a magnetic key is required to be placed in close proximity to the magnetically actuated switch to actuate the switch.

In a further non-limiting embodiment of the method of any of the previous paragraphs, the magnetically actuated switch includes at least one magnet and at least one switch contact. The at least one magnet moves based on magnetic interaction between the at least one magnet and the magnetic key, and movement of the at least one magnet moves the at least one switch contact between an open and a closed state.

In a further non-limiting embodiment of the method of any of the previous paragraphs, the device includes an indication or a characteristic that indicates a position of the magnetically actuated switch behind the surface.

In a further non-limiting embodiment of the method of any of the previous paragraphs, the indication or characteristic is on the surface.

Various features and advantages of at least one disclosed example embodiment will become apparent to those skilled in the art from the following detailed description. The drawings that accompany the detailed description can be briefly described as follows.

DETAILED DESCRIPTION

Elevator system devices designed according to an embodiment of this invention reduce the possibility for vandalism to such a device and reduce the likelihood of an unauthorized individual gaining access to features of an elevator system that are intended for limited access by authorized individuals. At the same time, such devices allow an authorized individual to gain access to such features in a convenient manner.

Figure 1:
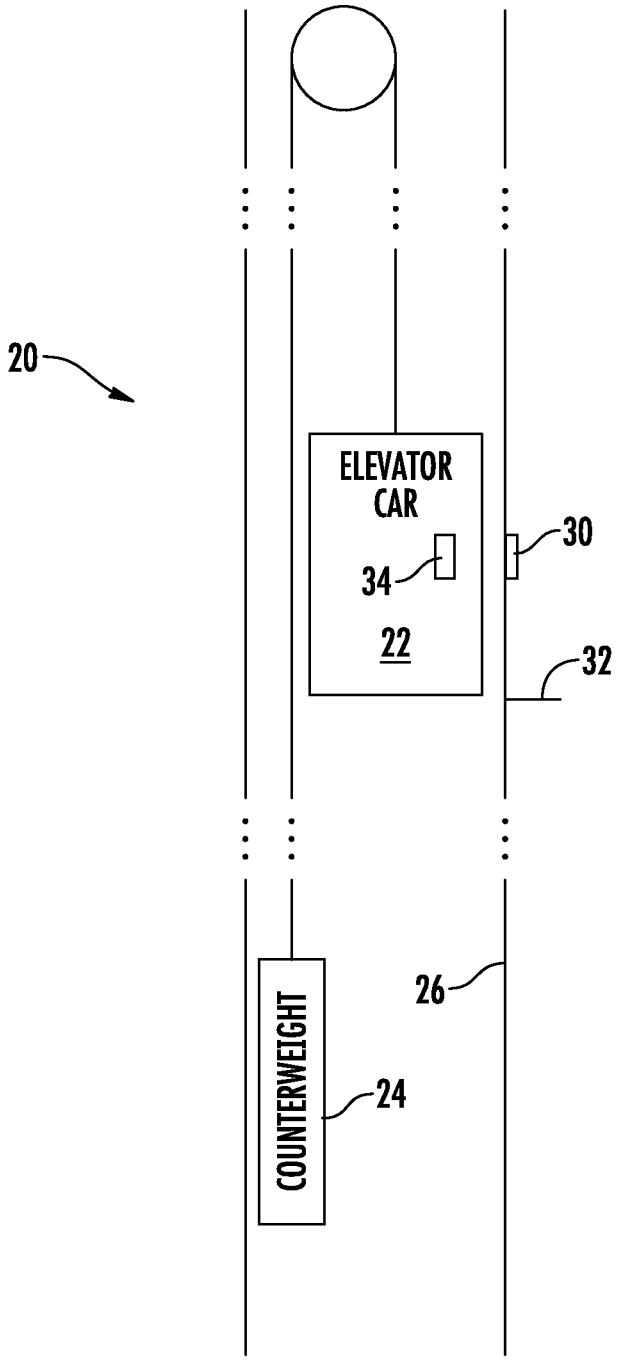
FIG. 1 schematically illustrates selected portions of an elevator system including a device designed according to an embodiment of this invention.

FIG. 1 schematically illustrates selected portions of an elevator system 20. An elevator car 22 and counterweight 24 are situated within a hoistway 26 in a known manner. The elevator car 22 is used for carrying passengers between various landings within a building, for example.

An elevator system device 30 is situated near a landing 32 to allow passengers to communicate with the elevator system 20. The elevator system device 30 can allow a passenger, for example, to request elevator service or to receive an indication regarding elevator service. Another elevator system device 34 is included on the elevator car 22. In some examples, the device 34 is a car operating panel that allows a passenger to request service to a particular floor, for example. The device 34 may also communicate information to passengers regarding elevator system operation or service. The particular configuration of the elevator system devices 30 and 34 may vary depending on the location and intended operation of those devices.

Figure 2:
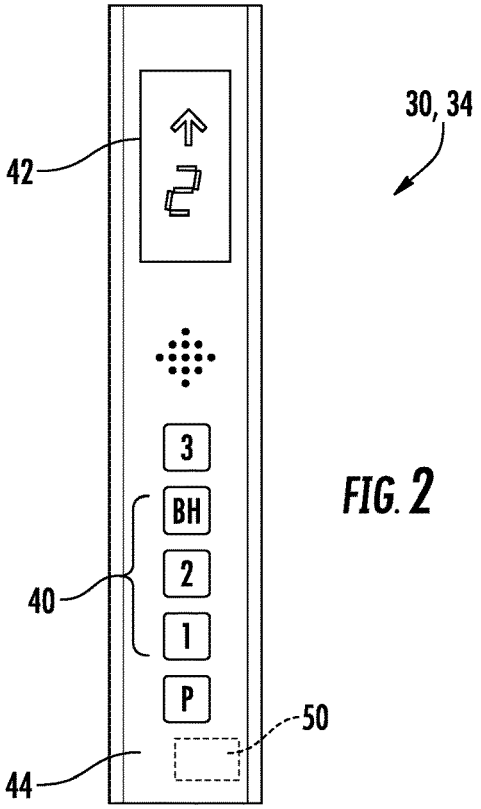
FIG. 2 schematically illustrates an example elevator system device designed according to an embodiment of this invention.

FIG. 2 schematically illustrates an example elevator system device 30 or 34. A passenger interface portion includes a keypad 40 and a display screen 42. The passenger interface portion allows a passenger to provide an indication regarding desired elevator service or otherwise to communicate information to the elevator system. The passenger interface portion also allows for a passenger to receive information from the elevator system, such as an indication of how the elevator system will address the passenger's request for service.

The device 30 or 34 as shown in FIG. 2, includes a surface 44 adjacent the passenger interface portion. The surface 44 in this example provides an aesthetic surround adjacent the passenger interface portion. A magnetically actuated switch 50 is concealed behind the surface 44 so that the switch 50 is not visible to an elevator passenger or another individual looking at the device 30, 34. The presence or location of the magnetically actuated switch 50 is provided to authorized individuals who need to gain access to features or control over the elevator system 20 for service or maintenance, for example.

The surface 44 in the illustrated example does not include any indication or characteristic that would suggest or indicate the presence of the magnetically actuated switch 50 behind the surface 44. Concealing the magnetically actuated switch 50 in a manner that leaves its presence undetectable to an ordinary observer reduces a likelihood for any attempted vandalism or unauthorized access to restricted features of the elevator system.

In other embodiments, the surface 44 or another portion of the device 30 includes an indication or characteristic that shows an authorized individual where the switch 50 is behind the surface 44. Such an indication may be informative to authorized individuals (e.g., elevator mechanics or maintenance personnel) without making the presence of the switch 50 apparent to a typical elevator passenger.

The magnetically actuated switch 50 allows an authorized individual to gain access to a variety of elevator system functions or features. For example, an authorized mechanic or technician may need to perform a power reset, a diagnostic procedure, or an update of the device 30, 34 or some other aspect of the elevator system 20 that can be accessed or controlled through an interaction with that device. Such an authorized individual has information or can obtain information regarding the location of the magnetically actuated switch 50 so that such an individual can gain the necessary access.

Figure 3:
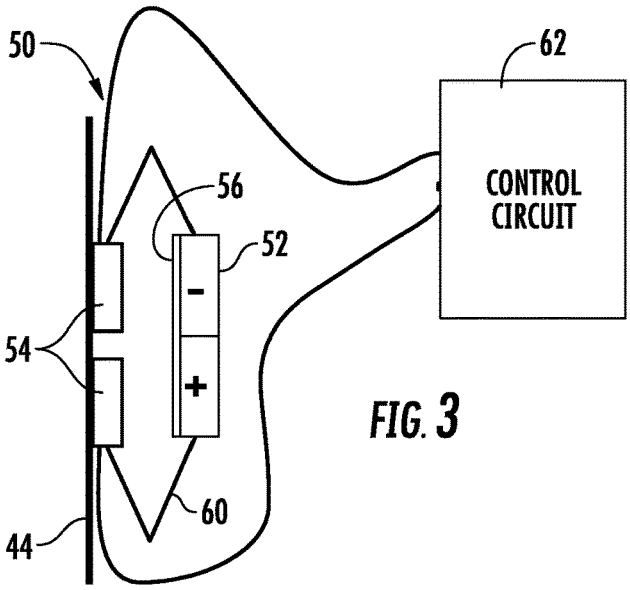
FIG. 3 schematically illustrates an example magnetically actuated switch designed according to an embodiment of this invention in a first condition.
Figure 4:
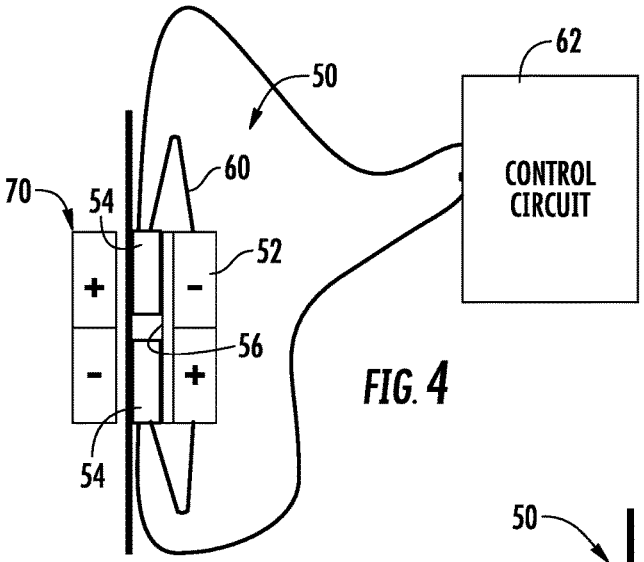
FIG. 4 illustrates the switch of FIG. 3 in another operating condition.

FIG. 3 schematically illustrates an example embodiment of a magnetically actuated switch 50. At least one magnet 52 is associated with at least one switch contact. In this example, there are multiple switch contacts 54 and 56 that are shown in an open or non-conducting state in FIG. 3. In this example, a biasing member 60 biases the contact 56 away from the contacts 54 to keep the switch in an open state. In the example of FIGS. 3 and 4, the biasing member 60 comprises a hinge-style spring.

As shown in FIG. 4, when an authorized individual places a magnetic key 70 in proximity to the switch 50, the magnet 52 is attracted to or drawn toward the magnetic key 70. The magnetic attraction between the magnetic key 70 and the magnet 52 overcomes the bias of the biasing member 60 to move the magnetically actuated switch 50 between the open state shown in FIG. 3 and the closed state shown in FIG. 4. Such movement of the magnet 52 causes the switch contact 56 to move into contact with the switch contacts 54 to complete or close a circuit. In this example, when the magnetically actuated switch 50 is in a closed state, electrical energy can flow through the switch 50 which provides an indication to a control circuit 62 that an authorized individual desires access to one or more features of the elevator system. The manner in which the control circuit 62 provides such access to an authorized individual can occur in a known manner.

Figure 5:
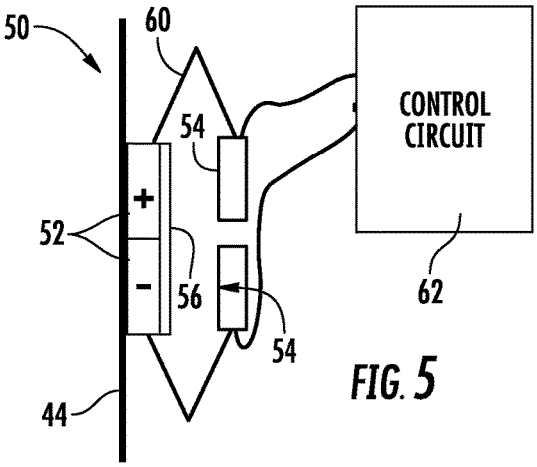
FIG. 5 schematically illustrates another example magnetically actuated switch configuration designed according to an embodiment of this invention.
Figure 6:
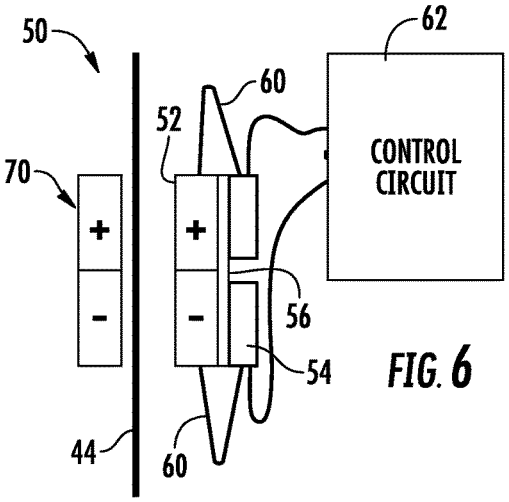
FIG. 6 illustrates the switch of FIG. 5 in another operating condition.

FIG. 5 schematically illustrates another example magnetically actuated switch configuration. In this example, the magnetically actuated switch 50 is in a normally open state but in this example, the presence of an appropriate magnetic key 70 causes movement of the magnet 52 away from the surface 44 to cause the contact 56 to move into conductive contact with the contacts 54. In this example, when the magnetic key 70 is situated to repel the magnet 52, the magnetically actuated switch 50 moves from an open to a closed state.

In either of the example switch configurations, the magnet 52 has a selected magnetic pattern, such as an arrangement of the magnet poles. The key 70 has to have a corresponding magnetic pattern to actuate the switch 50.

While the examples of FIGS. 3-6 include closing the magnetically actuated switch 50 to initiate authorized access to selected features of the elevator system, other switch configurations are in a normally closed state and opening the switch with an appropriate magnetic key initiates authorized access.

Having the magnetically actuated switch 50 concealed behind the surface 44 removes the presence of the switch 50 from public view. Additionally, there is no requirement for any openings or visible switches or buttons that might otherwise be susceptible to vandalism. Embodiments designed according to this invention, therefore, provide enhanced security over elevator system devices and features while still providing relatively convenient access for an authorized individual.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system device, comprising:

an interface configured to operate in a first mode that allows an elevator passenger to communicate with the elevator system by at least one of inputting an indication for desired elevator service and receiving an indication regarding elevator service; and a magnetically actuated switch that selectively causes the interface to operate in a second mode that allows an authorized individual to communicate with the elevator system in a manner that is different than an elevator passenger communication in the first mode, the magnetically actuated switch including at least one magnet and at least one switch contact that changes between an open and closed state based on an interaction between the at least one magnet and a magnetic key brought into proximity of the at least one magnet by the authorized individual.

2. The elevator system device of claim 1, comprising a surface that is visible to the passenger or authorized individual, and wherein the magnetically actuated switch is situated behind a portion of the surface that conceals the magnetically actuated switch from the passenger.

3. The elevator system device of claim 2, wherein the surface has a visible characteristic on the portion of the surface that does not provide any indication of the magnetically actuated switch behind the surface.

4. The elevator system device of claim 1, wherein the magnetically actuated switch includes a biasing member that biases the at least one switch contact into a selected one of the open or closed states; and the at least one magnet causes movement of the at least one switch contact into the other of the closed or open state by moving the at least one switch contact against the bias of the biasing member based on the interaction between the at least one magnet and the magnetic key.

5. The elevator system device of claim 4, wherein the biasing member comprises a spring.

6. The elevator system device of claim 4, wherein the biasing member comprises a hinge-style spring.

7. The elevator system device of claim 1, wherein the device comprises a controller that controls whether the interface operates in the first mode or the second mode; and actuation of the magnetically actuated switch provides an indication to the controller to operate in the second mode to allow the authorized individual to communicate with the elevator system.

8. The elevator system device of claim 1, wherein the at least one magnet has a selected magnetic pattern; and the magnetic key has a corresponding magnetic pattern to activate the magnetically activated switch.

9. The elevator system device of claim 1, wherein the at least one magnet is supported to move based on the interaction with the magnetic key; and movement of the at least one magnet causes movement of the at least one switch contact between the open and closed states.

10. The elevator system device of claim 9, wherein at least one of magnetic attraction or magnetic repulsion between the at least one magnet and the magnetic key causes the movement of the at least one magnet.

11. The elevator system device of claim 1, wherein the at least one switch contact is electrically conductive when the at least one switch contact is in the closed state;

the at least one switch contact is electrically conductive independent of a magnetic field of the at least one magnet; and the at least one switch contact is electrically conductive independent of a magnetic field of the magnetic key.

12. The elevator system device of claim 1, comprising a surface adjacent to the interface and wherein the surface is visible to the passenger;

the magnetically actuated switch is concealed from the passenger's view behind the surface; and the device includes an indication of the magnetically actuated switch position behind the surface.

13. The elevator system device of claim 12, wherein the surface has an indicator or a characteristic that indicates that the magnetically actuated switch is behind the surface.

14. A method of preventing unauthorized access to features of an elevator system device, the method comprising:

situating a passenger interface portion of the device in a location where the passenger interface portion is accessible by an elevator passenger;

situating a magnetically actuated switch near the passenger interface portion, the magnetically actuated switch controlling an ability to access preselected features of the elevator system; and concealing the magnetically actuated switch such that the magnetically actuated switch is not visible to the elevator passenger.

15. The method of claim 14, comprising concealing the magnetically actuated switch behind a surface adjacent the passenger interface portion.

16. The method of claim 15, wherein the surface does not have any indicator or characteristic that would indicate that the magnetically actuated switch is behind the surface.

17. The method of claim 14, comprising requiring a magnetic key to be placed in close proximity to the magnetically actuated switch to actuate the switch.

18. The method of claim 17, wherein the magnetically actuated switch includes at least one magnet and at least one switch contact;

the at least one magnet moves based on magnetic interaction between the at least one magnet and the magnetic key; and movement of the at least one magnet moves the at least one switch contact between an open and a closed state.

19. The method of claim 15, wherein the device includes an indication or a characteristic that indicates a position of the magnetically actuated switch behind the surface.

20. The method of claim 19, wherein the indication or characteristic is on the surface.

* * * * *